US005337987A

United States Patent [19]

Sawatsky

[11] Patent Number: 5,337,987

[45] Date of Patent: Aug. 16, 1994

[54] ARTICLE STORAGE ORGANIZER

[76] Inventor: Kim R. Sawatsky, 13014 Dixie Rd., Brampton, Ontario, Canada, L6T 3S1

[21] Appl. No.: 51,393

[22] Filed: Apr. 23, 1993

[51] Int. Cl.[5] ..... A47B 96/06

[52] U.S. Cl. ..... 248/231.8; 24/543; 248/316.7

[58] Field of Search ..... 248/231.8, 229, 316.7, 248/221.3, 222.1, 222.2, 222.3, 225.1, 231.3; 24/543, 295; 40/361, 367

[56] References Cited

U.S. PATENT DOCUMENTS

| | | | |
|---|---|---|---|
| D. 301,548 | 6/1989 | Weaver | D9/434 |
| 3,141,221 | 11/1962 | Faulls, Jr. | 24/30.5 |
| 3,266,711 | 5/1965 | Song | 229/62 |
| 3,621,539 | 11/1971 | Ayers | 24/30.5 |
| 4,220,301 | 9/1980 | Jacobs et al. | 24/543 X |
| 4,534,089 | 8/1985 | Swan | 24/559 |
| 4,786,022 | 11/1988 | Grieshaber | 248/231.3 X |
| 4,845,807 | 7/1989 | Rooney | 248/222.2 X |
| 5,236,760 | 8/1993 | Jinn | 248/231.8 X |

*Primary Examiner*—Ramon O. Ramirez
*Attorney, Agent, or Firm*—Dowell & Dowell

[57] ABSTRACT

An article storage system for retaining and storing articles which includes a mounting track for attaching to a wall, door, or like surface, and clips slidably received within a channel of the mounting track for holding the articles in their stored positions. The clips are pivotable between opened and closed positions relative to the track and are structured to be retained in either position. The article storage system may further include a strip for identifying the articles, and a mounting bracket for mounting the storage system to a cabinet door.

15 Claims, 2 Drawing Sheets

ARTICLE STORAGE ORGANIZER

BACKGROUND OF THE INVENTION

1. Field of the Invention

This invention relates to an article storage system and, more particularly, to a system for storing articles used in the household or garage which comprises a mounting track for attaching the storage system to a surface such as a wall, metal cabinet or door, and slidable clips which are received in the mounting track for holding the articles in their stored positions.

2. History of the Related Art

There are a number of systems for storing relatively small and lightweight articles known in the art. For example, pegboard systems are known for hanging articles in a vertical orientation using pegboard hooks that are removably attached to pegboards. These systems are, however, undesirable for several reasons. The pegboards are frequently large and relatively heavy. As a consequence, the pegboards must be mounted to attachment surfaces using permanent fasteners such as screws, and, consequently, the pegboards are usually not readily movable. Furthermore, changing the locations of the stored articles requires that the hooks must be removed completely from their respective holes in the pegboard and then reinserted into other holes. After a period of use, the holes tend to become worn and enlarged, and eventually unable to retain the hooks. Also, the hooks are easily misplaced or lost. Finally, these pegboard systems are aesthetically unattractive.

Storage devices such as magnetic clips are also known in the art. Magnetic devices are also undesirable because they are attachable only to metal surfaces, and so are only used for storing objects on household refrigerator doors or metal cabinets. Furthermore, these magnetic clips have limited storage capacity as they usually only provide a single clip for storing objects.

SUMMARY OF THE INVENTION

The present invention has been made in view of the above inadequacies of the prior art and has as an object to provide an article organizer system that is relatively small, lightweight, and durable, and which can be mounted on wood, metal and other surfaces.

Another object of the present invention is to provide an article organizer system that can be mounted to surfaces using a variety of different conventional fasteners.

A further object of the present invention is to provide an article organizer system that may be used to identify the stored articles.

A still further object of the present invention is to provide an article organizer system that allows the articles to be easily arranged on, and removed from, the system.

To achieve the objects of the invention, as embodied and broadly described herein, the article organizer system of the present invention includes an elongated mounting track which is selectively mounted to a surface. The mounting track includes a base mounting portion, a substantially arcuate shaped intermediate portion, and a front portion which are integrally formed. The intermediate portion defines an elongated open channel. The front portion includes at least one groove which extends the entire length of the mounting track and is oriented towards the base. The base includes upper and lower substantially flat mounting portions which are joined by an inwardly extending arcuate wall segment. The article organizer system further includes at least one clip which is pivotably receivable within the channel of the track for retaining cards or bags in which various articles may be stored. Each clip has a substantially arcuate shaped head portion having a pair of spaced projections extending outwardly therefrom. The head portion is generally C-shaped having spaced ends which are spaced and offset with respect to one another about an axis about which each clip pivots. The outer surface of the head portion functions as a cam and binds against the surfaces defining the channel dependent upon the relative positioning of the clip therein. In this respect, the radius of the outer surface of the head portion continuously changes.

Each clip also includes a lever which is integrally formed with the head portion and which extends outwardly therefrom through the open channel when the clip is mounted therein. This lever not only functions as a member for maneuvering the head portion, but also limits the degree of relative rotation of the head portion within the channel between a first position, wherein the head portion binds against surfaces defining the channel to thereby engage clamp articles therebetween, to a second position wherein the head portion is retained within the channel to thereby permit the insertion or removal of articles from the storage system. The clips are retained in either the first, fully closed position or second, fully open position, by engagement of the projections along the head portion within the groove formed in the track.

In the preferred embodiment, the front portion of the track includes an upstanding flange to which a separate plate or labelling strip may be supported for purposes of providing a mounting surface upon which various indicia may be placed to thereby either identify, advertise or otherwise provide information relating to the articles being retained by the storage system.

In an alternate embodiment, the invention includes a generally U-shaped bracket having leg portions which are frictionally engageable on opposite sides of a support surface, such as a cabinet door, to thereby retain the bracket in engagement therewith. One of the legs of the bracket includes opposing channels in which the base of the track is slidably received.

DETAILED DESCRIPTION OF THE PREFERRED EMBODIMENTS

Figure 1:
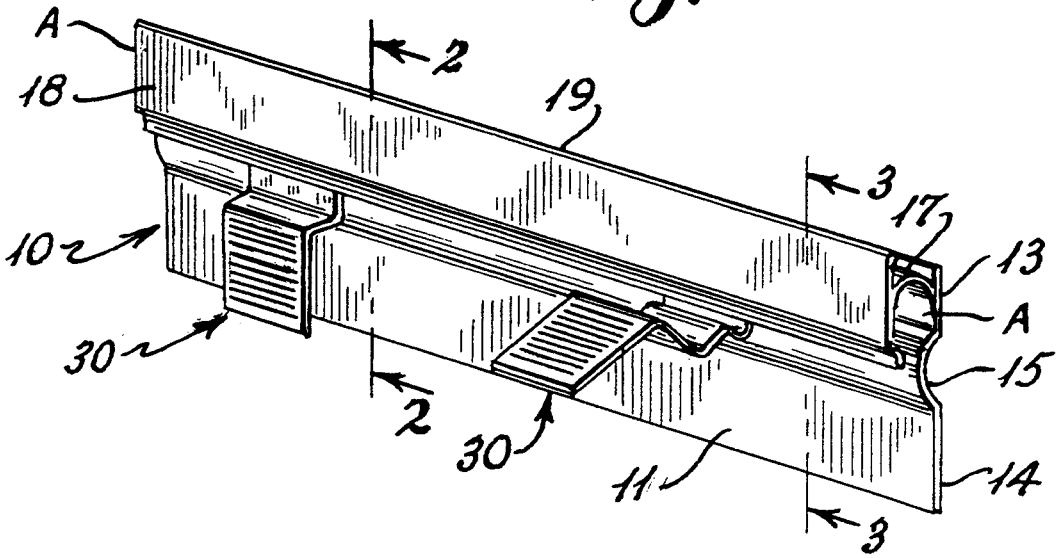
FIG. 1 is a perspective view of the article organizer of the invention, depicting the left clip in the fully closed position and the right clip in the fully open position.

With reference to the drawings, FIG. 1 depicts the article organizer 10 in accordance with the invention. The organizer includes a mounting track 11 and a plurality of clips 30. The left clip is shown in the fully closed position and the right clip is shown in the fully open position. An article 40 is shown associated with the right clip. In this position of the clip, the article may be inserted or removed from the organizer.

Figure 2:
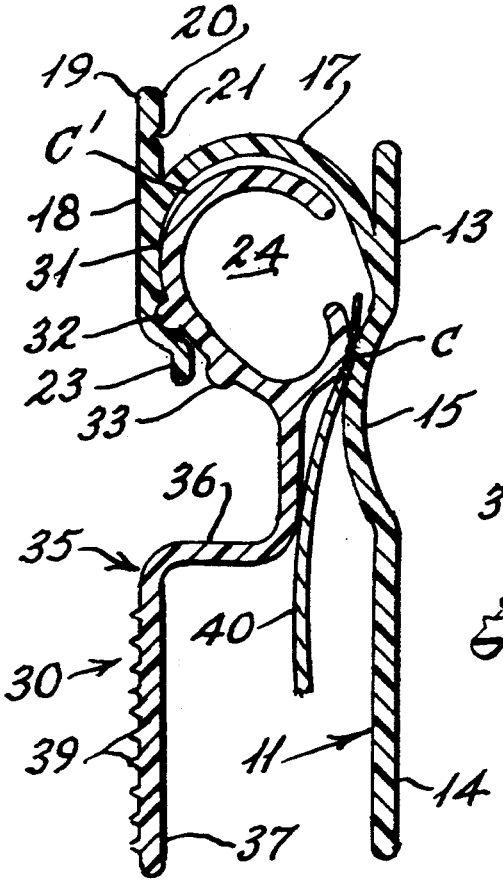
FIG. 2 is a partial cross-sectional view of the article organizer taken along Section 2—2 of FIG. 1, showing the clip in the fully closed position and further depicting an article secured by the clip.

FIG. 2 depicts the structure of the mounting track 11 in accordance with the invention. The mounting track includes a base having two straight mounting portions: an upper mounting portion 13 and a lower mounting portion 14, the mounting portions being separated by a curved portion 15. The curved portion preferably has a plurality of ridges 16 along a portion of the inner surface, as shown. The purpose of these ridges will be explained in more detail below.

The mounting portions 13 and 14 provide surfaces for attachment to a wall, door, cabinet, or the like. As embodied herein, attachment means such as screws, double-sided adhesive tape, magnetic tape, adhesive, mounting brackets, or the like may be used.

The mounting track further includes an intermediate portion 17 which extends between the upper base portion 13 and a front portion 18. The intermediate portion is substantially arcuately shaped, and has a variable radius over its length.

The front portion 18 of the mounting track includes a substantially flat outer surface having an upwardly extending flange 19, and an inner surface 20 which includes a groove 21 which extends the entire length of the mounting track. Below the intermediate portion 17, the inner surface of the front portion is arcuately shaped. The inner surfaces of the front portion, intermediate portion and the curved portion of the base define an elongated open channel 24 in which the clips 30 are selectively received. The surfaces defining the channel are not symmetrical to a single axis "A—A" extending along the length thereof. A groove 22 which extends the entire length of the mounting track in open communication with the channel 24. Below the groove 22, the front face includes a reversely curved lower flange 23.

In accordance with the invention, the mounting track is preferably molded of a pliable plastic material.

Figure 3:
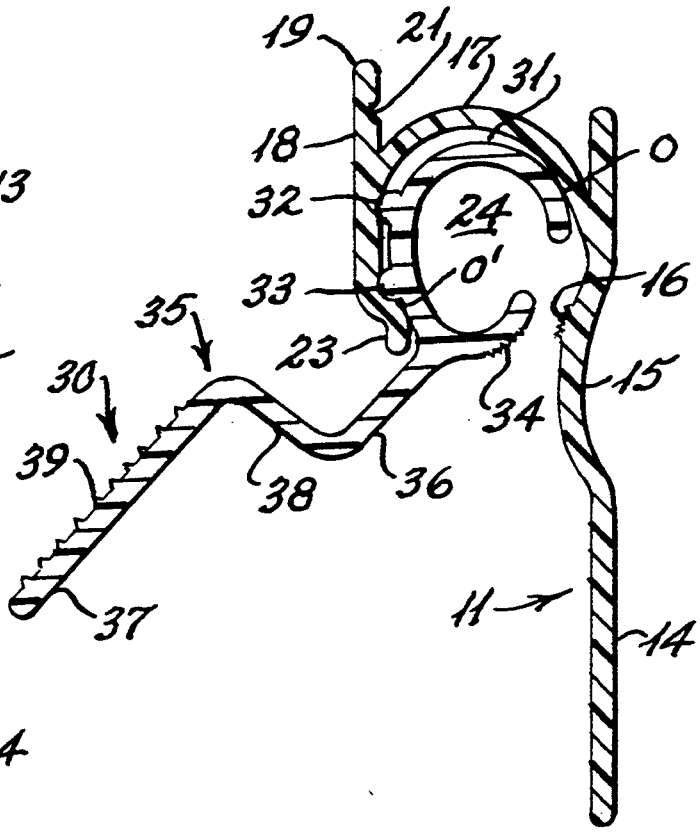
FIG. 3 is a partial cross-sectional view of the article organizer taken along Section 3—3 of FIG. 1, showing the clip in the fully open position.

FIG. 3 depicts a clip 30 in accordance with the invention. The clip includes a substantially arcuate C-shaped head portion 31, having spaced projections 32 and 33 adjacent the center of its outer surface. A plurality of ridges 34 are provided along the lower and outer surface of the head portion and which are provided for meshing with the ridges 16 of the track. The head portion of the clip defines an outer arcuate cam surface which is not symmetrical with respect to the imaginary axis "A—A" about which the head pivots when the head is positioned within the channel 24 of the track. Thus, the radius of the outer cam surface varies. This permits the head portion to bind against the surfaces of the track defining the channel 24 depending upon the relative positioning of the clip to the track. The clip further includes a lever 35 which is integrally formed with the head portion and which extends outwardly therefrom between the projection 33 and the ridges 34. In this manner, the lever extends outwardly through the elongated opening into the channel 24. To facilitate gripping the lever to pivot the clip between the fully closed position shown in FIG. 2 to the fully open position shown in FIG. 3, the outer portion 37 thereof is offset with respect to the inner portion 36 and is connected by an intermediate portion 38. The offset orientation of the outer portion 37 causes it to be directed parallel to and spaced from the lower base mounting portion 14 of the track when the clip is in the fully closed position. As a result, the outer portion 37 may be easily gripped so that the clip may be pivoted to a fully opened position to release articles supported by the organizer. A plurality of ridges 39 are located on one or both of the exterior and interior surfaces of the outer portion 37. These ridges provide an improved gripping surface.

In accordance with the invention, the clips are preferably composed of a pliable plastic material. The clips may be colored differently from the mounting track.

The operation of the article organizer will now be explained with reference to FIGS. 2 and 3. FIG. 2 depicts clip 30 in the closed position. As shown in this figure, the projection 32 is engaged within the groove 22 of the mounting track 11. Furthermore, the outer surface of the arcuate head portion 31 of the clip frictionally contacts the surfaces defining the channel 24 at regions C and C'. These points of contact, which include the meshed ridges 16 and 34, in combination with the engagement of the projection 32 within groove 22, firmly hold the clip in the closed position. Further, the meshed ridges 16 and 34 will frictionally retain articles between the clip and the track.

In order to place the clip 30 in the fully opened position, the clip is rotated or pivoted away from the base mounting portion of the track until it reaches the position depicted in FIG. 3. As the clip is rotated toward the fully open position, projection 32 is disengaged from the groove 22, and the frictional contacts C and C' are overcome by the arcuate shaped portion of the clip moving away from those positions. As the clip pivots to the fully opened position, the projection 33 contacts and rides along and deflects the inner surface of the reversely curved flange 23 until it is snapped into engagement within the groove 22. The clip is thereby retained in the fully opened position; the clip is firmly held by the combination of the engagement of the projection 33 in the groove 22, and by the two frictional points of contact O and O' between the head portion of the clip and the surfaces defining the channel of the track. It should also be noted that the curvature of the outer surface of the head portion of the clip between the projection 33 and the lever 35, is curved so as to complementarily engage the flange 23, thereby preventing or limiting further outward pivoting motion of the lever 35 relative to the track.

With continued reference to FIG. 3, in order to retain an article to the organizer for storage, the clip 30 is placed in an open position and the article 40 is inserted until it contacts the clip and the curved portion 15 of the mounting track. The clip is then pivoted toward the base mounting portion of the track until it comes to the fully closed position of FIG. 2. In this position, the projection 32 will engage within the groove 22, and frictional points of contact C and C' will be created as shown in FIG. 2. The friction contact will be directly between the clip and the article and the article and mounting track. Furthermore, as explained above, the ridges 16 and 34 will cooperate to bind the article between the clip and track.

To remove the article from the storage system, the clip is pivoted to the open position depicted in FIG. 3, and the article 40 is pulled downwardly.

It is understood that the dimensions of the article organizer may be varied to accommodate storage needs and available space. Furthermore, the size and number of the clips may be varied.

Figure 4:
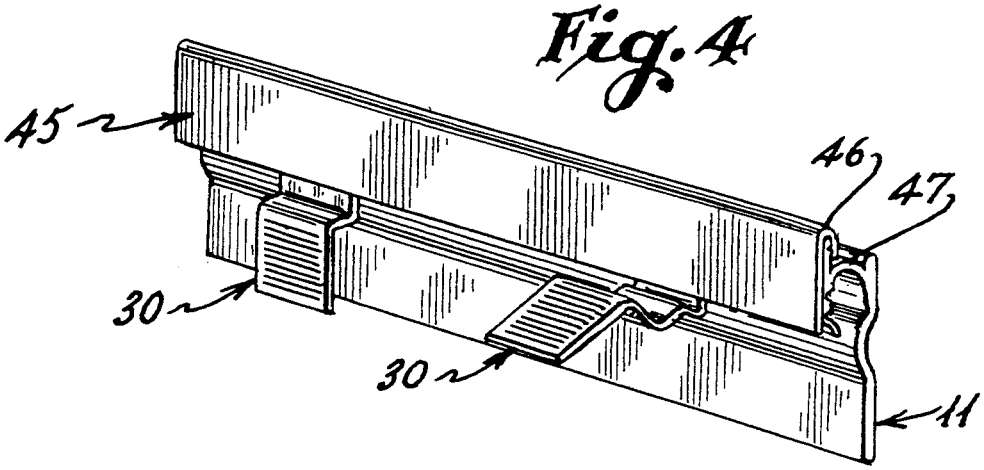
FIG. 4 is a perspective view of the article organizer with an attached labelling strip.

In accordance with the invention, and as depicted in FIG. 4, the article organizer system may further include a labelling strip 45 for identifying the contents of the stored articles. The article contents may be written directly on the front face of the strip 45, or alternatively labels identifying the contents may be attached to the strip adjacent to their corresponding articles.

The strip 45 is preferably composed of a pliable plastic material and shaped to fit over and to slide along the upstanding flange 19 of the mounting track. More particularly, the strip 45 includes a hooked upper edge 46 having a rib 47 along the back edge thereof. The rib 47 engages within the groove 21 located in the rear of the front portion of the mounting track. The strip therefore is slidable along the length of the mounting track.

Figure 5:
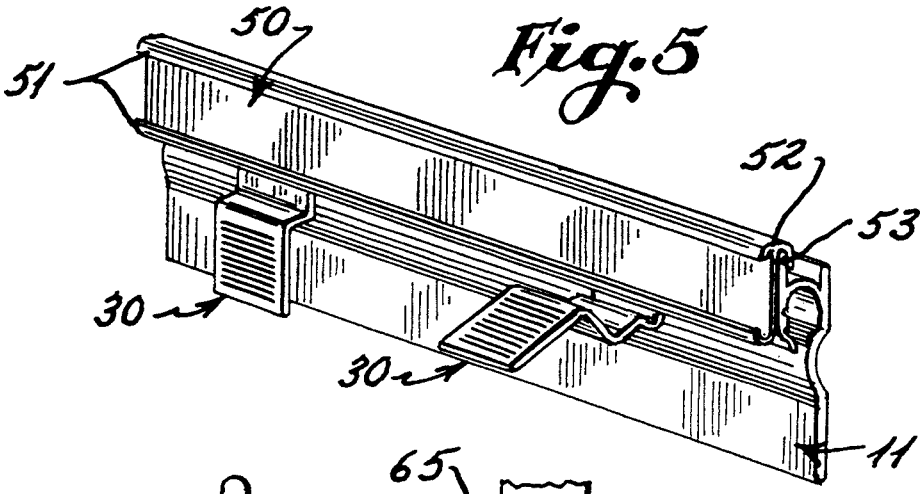
FIG. 5 is a perspective view of the article organizer with an attached labelling track for receiving information labels to identify the articles mounted thereto.

A strip 50 having a different structure is depicted in FIG. 5. Strip 50 includes a track having opposite flanges 51 for receiving information cards (not shown) for identifying the contents of the articles retained by the article organizer. The information cards are positioned adjacent to their corresponding articles by sliding the cards along the track. The strip 50 also includes an upper hooked edge 52 having a rib 53 which is engaged within the groove 21 of the mounting track 11.

Figure 6:
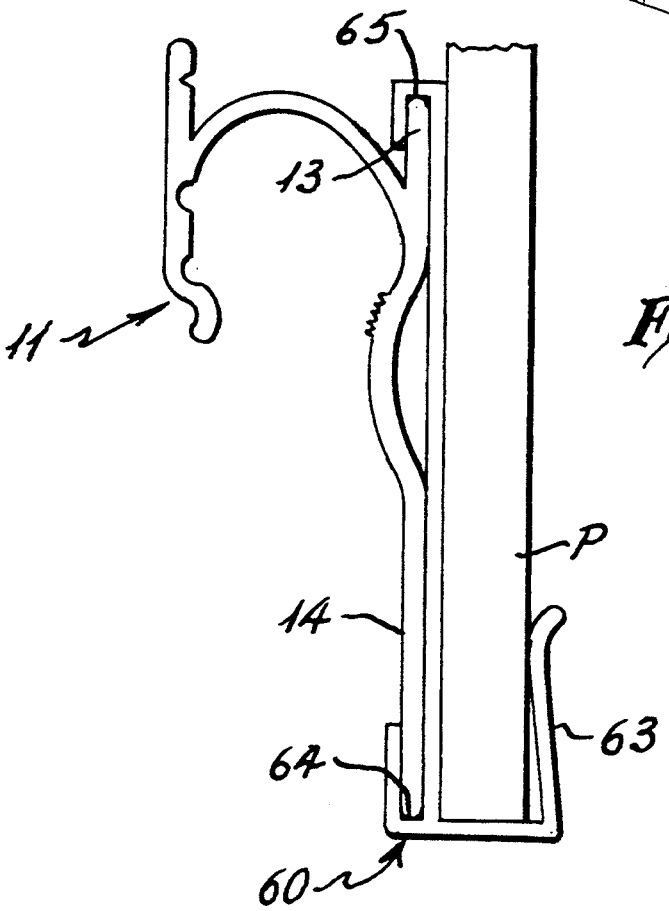
FIG. 6 is a side elevational view of the mounting track of the article organizer supported by a mounting bracket which is placed on a cabinet door.

As depicted in FIG. 6, the article organizer may further include a mounting bracket 60 which is configured to support the mounting track 11 to a structure such as cabinet door 70. More particularly, the bracket includes spaced clamping leg portions 62 and 63 which are joined to form a U-shape. The mounting bracket further includes a pair of opposing channel members 64 and 65 in which the upper and lower base mounting portions 13 and 14 of the track 11 are engaged. The clamping leg 63 is angled toward the cabinet door 70 and contacts the cabinet door at position "P". This contact maintains the bracket firmly in position on the door. As shown, the bracket is engaged with a lower edge of a door; however, by simply inverting the bracket, the bracket may be suspended from the upper edge of the door. In accordance with the invention, the mounting bracket is preferably composed of a pliable plastic material.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

I claim:

1. An article support and organizer comprising:

an elongated mounting track having a base, an intermediate arcuate portion extending from said base and a front portion, each of said base, intermediate and front portions having inner and outer surfaces, an elongated open channel defined by said inner surfaces, at least one clip having a head portion slidably and pivotably disposed within said channel, a lever means extending from said head portion and outwardly of said channel, said head portion of said clip being pivotable between first and second positions with respect to said channel, said head portion having an outer arcuate cam surface which is not symmetrical with respect to said inner surfaces defining said channel so that said cam surface is frictionally engageable with two spaced and generally opposite points of said inner surfaces when said head portion is in either of said first or second positions, whereby when said head portion of said clip is in said first position, an article may be selectively inserted between said clip and said inner surface of said track and when said head portion is in said second position, said head portion binds the article against said inner surface of said track to thereby retain the article therebetween.

2. The article support and organizer of claim 1, in which said head portion of said clip is generally C-shaped having spaced ends which are not symmetrically spaced with respect to a common axis.

3. The article support and organizer of claim 2, in which said head portion includes at least one projection extending from said cam surface, a groove extending along a portion of said inner surfaces of said track, and said at least one projection being engageable within said groove when said head portion is in one of said first or second positions.

4. The article support and organizer of claim 3, including a pair of spaced projections extending from said cam surface, one of said projections being receivable within said groove when said head portion is in said first position and the other of said projections being engageable within said groove when said head portion is in said second position.

5. The article support and organizer of claim 4 including first ridges extending from said inner surfaces of said track and second ridges extending from said cam surface of said clip, said first and second ridges being in opposing relationship with respect to one another when said head portion is in said second position.

6. The article support and organizer of claim 5, in which said front portion of said track includes a reversely curved flange extending away from said channel, a portion of said lever abutting said flange when said head portion is in said first position.

7. The article support and organizer of claim 6, in which said second ridges and said pair of projections are positioned on opposite sides of said lever.

8. The article support and organizer of claim 1, in which said front portion of said track includes an upstanding flange, a labelling strip having an upper hooked edge slidably mounted over said flange, said strip having an outer surface upon which various indicia may be applied.

9. The article support and organizer of claim 8, in which said upstanding flange includes a groove, said labelling strip including a rib which is engageable within said groove.

10. The article support and organizer of claim 1, in which said front portion of said track includes an upstanding flange, a labelling track means mounted to said upstanding flange, said labelling track means having opposing channels for receiving a card means therebetween.

11. The article support and organizer of claim 8, further comprising a mounting bracket having opposing leg portions and means for supporting said base of said mounting track thereto.

12. The article support and organizer of claim 10, further comprising a mounting bracket having opposing leg portions and means for supporting said base of said mounting track thereto.

13. The article support and organizer of claim 1, further comprising a mounting bracket having opposing leg portions and means for supporting said base of said mounting track thereto.

14. The article support and organizer of claim 13, in which said means for supporting said base includes a pair of spaced channels means.

15. The article support and organizer of claim 1, wherein said mounting track and said clip are composed of a pliable plastic material.

* * * * *